US007463213B2

(12) United States Patent
Nakano et al.

(10) Patent No.: US 7,463,213 B2
(45) Date of Patent: Dec. 9, 2008

(54) ANTENNA UNIT HAVING A SINGLE ANTENNA ELEMENT AND A PERIODIC STRUCTURE UPPER PLATE

(75) Inventors: Hisamatsu Nakano, Tokyo (JP); Hidekazu Umetsu, Tokyo (JP); Yoichi Asano, Tokyo (JP); Junji Yamauchi, Tokyo (JP); Akira Miyoshi, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 11/699,815

(22) Filed: Jan. 30, 2007

(65) Prior Publication Data

US 2007/0200788 A1 Aug. 30, 2007

(30) Foreign Application Priority Data

Feb. 28, 2006 (JP) ..... 2006-053905

(51) Int. Cl.
*H01Q 15/02* (2006.01)
*H01Q 1/38* (2006.01)

(52) U.S. Cl. ..... 343/909; 343/700 MS; 343/912; 343/787

(58) Field of Classification Search ..... 343/909, 343/912

See application file for complete search history.

(56) References Cited

U.S. PATENT DOCUMENTS 6,483,481 B1 * 11/2002 Sievenpiper et al. ..... 343/909
6,549,172 B1 * 4/2003 Thevenot et al. ..... 343/756
7,145,518 B2 * 12/2006 Tanaka et al. ..... 343/909
2003/0011522 A1 1/2003 McKinzie, III et al.
2005/0128148 A1 * 6/2005 Anguera Pros et al. ..... 343/700 MS

OTHER PUBLICATIONS

Zhu Fangming et al, "High-directivity Patch Antenna with Both Perfect Magnetic Conductor Substrate and Photonic Bandgap Cover." Asia Pacific Microwave Conference Proceedings, APMC; 2005, vol. 1, Zhejiang University, Yu-Quan, Hangzhou, China.
Min Qiu et al, "High-directivity Patch Antenna with Both Photonic Bandgap Cover," Microwave and Optical Technology Letters, Jul. 5, 2001, pp. 41-44, vol. 30, No. 1, Wiley, USA.
Yang Fan et al, "Applications of Electromagnetic Band-Gap (EBG) Structures in Microwave Antenna Designs." International Conference on Microwave and Millimeter Wave Technology, XX, XX, 2003, pp. 528-531, University of California, Los Angeles, USA.

(Continued)

*Primary Examiner*—Trinh V Dinh
(74) *Attorney, Agent, or Firm*—Frishauf, Holtz, Goodman & Chick, P.C.

(57) ABSTRACT

An antenna unit consists of an EBG reflector, a single curl antenna supported at a central portion of the EBG reflector, and a periodic structure upper plate disposed apart from a principal surface of the EBG reflector by a predetermined distance. The EBG reflector includes a substrate having the principal surface and (Nx×Ny) square patches which are printed on the principle surface of the substrate and which are arranged in a matrix fashion (lattice structure). The periodic structure upper plate consists of a film and (Nx×Ny) square patch-like conductors printed on the film. The (Nx×Ny) square patch-like conductors are disposed so as to oppose to the (Nx×Ny) square patches, respectively.

4 Claims, 5 Drawing Sheets

OTHER PUBLICATIONS

Shaker J et al, "Application of Fabry-Perot Resonator for Sidelobe Suppression of Antenna Elements and Array," 31st European Microwave Conference Proceedings, Sep. 21-27, 2001. vol. 3, London.

Salonen P et al, "WEBGA—Wearable Electromagnetic band-gap Antenna," Antennas and Propogation Society Symposium, 2004. vol. 1, Jun. 20, 2004. IEEE Monteray CA, USA.

Young Ju Lee et al, "Design of a High-Directivity Electromagnetic Bank Gap (EBG) Resonator Antenna Using a Frequency-Selective Surface (FSS) Superstrate," Microwavve and Optical Technology Letters,Dec. 20, 2004, vol. 43, No. 6, Wiley, USA.

Nakano H et al, "Monofilar Spiral Antenna Array Above an EBG Reflector," Proceedings of the 2005 International Symposium on Antennas and Propagation (ISAP 2005) Korea Electromagnetic Engineering Society, 2005, pp. 629-632, vol. 2, Seoul, South Korea.

* cited by examiner

ANTENNA UNIT HAVING A SINGLE ANTENNA ELEMENT AND A PERIODIC STRUCTURE UPPER PLATE

This application claims priority to prior Japanese patent application JP 2006-53905, the disclosure of which is incorporated herein by reference.

BACKGROUND OF THE INVENTION

This invention relates to an antenna unit and, in particular, to an antenna unit using an EBG (Electromagnetic Band Gap) reflector.

As one of antenna units, a monofilar spiral array antenna is proposed in article which is contributed by Hisamatsu Nakano et al to Int. Symp. Antennas and Propagation (ISAP), pages 629-632, Soul, Korea, August 2005, and which has a title of "A monofilar spiral antenna array above an EBG reflector." In the manner which will later be described in conjunction with FIGS. 1 through 3, the monofilar spiral array antenna disclosed in the article comprises a mushroom-like EBG reflector and first through fourth array elements which are spaced with an array distance in the x-direction. The first through the fourth array elements are backed by the mushroom-like EBG reflector. Each array element is composed of one vertical filament and N horizontal filaments. Each array element is called a curl antenna. The mushroom-like EBG reflector is composed of (Nx×Ny) square patches. At any rate, this article reports gain enhancement of curl antennas by using array technique.

However, it is necessary for the monofilar spiral array antenna to arrange, as an antenna device, a plurality of curl antennas in an array fashion. Therefore, the monofilar spiral array antenna is disadvantageous in that a feeding method is complicated.

SUMMARY OF THE INVENTION

It is therefore an object of the present invention to provide an antenna unit which is capable of encouraging gain enhancement of an antenna device without using array technique.

Other objects of this invention will become clear as the description proceeds.

According to an aspect of this invention, an antenna unit comprises an EBG (Electromagnetic Band Gap) reflector having a principal surface, an antenna element supported by the EBG reflector, and a periodic structure upper plate disposed apart from the principal surface of the EBG reflector by a predetermined distance.

In the antenna unit according to the aspect of this invention, the antenna element may be substantially disposed in a center of the EBG reflector. The antenna element may comprise a curl antenna. The EBG reflector may comprise a substrate having the principal surface and (Nx×Ny) square patches which are printed on the principle surface of the substrate and which are arranged in a matrix fashion. In this event, the periodic structure upper plate preferably may comprise a film and (Nx×Ny) square patch-like conductors printed on the film. The (Nx×Ny) square patch-like conductors are disposed so as to oppose to the (Nx×Ny) square patches, respectively. The EBG reflector further may comprise a ground plate disposed on a rear surface of the substrate and (Nx×Ny) conductive-pins for short-circuiting the (Nx×Ny) square patches to the ground plate, respectively.

DESCRIPTION OF THE PREFERRED EMBODIMENT

Figure 1:
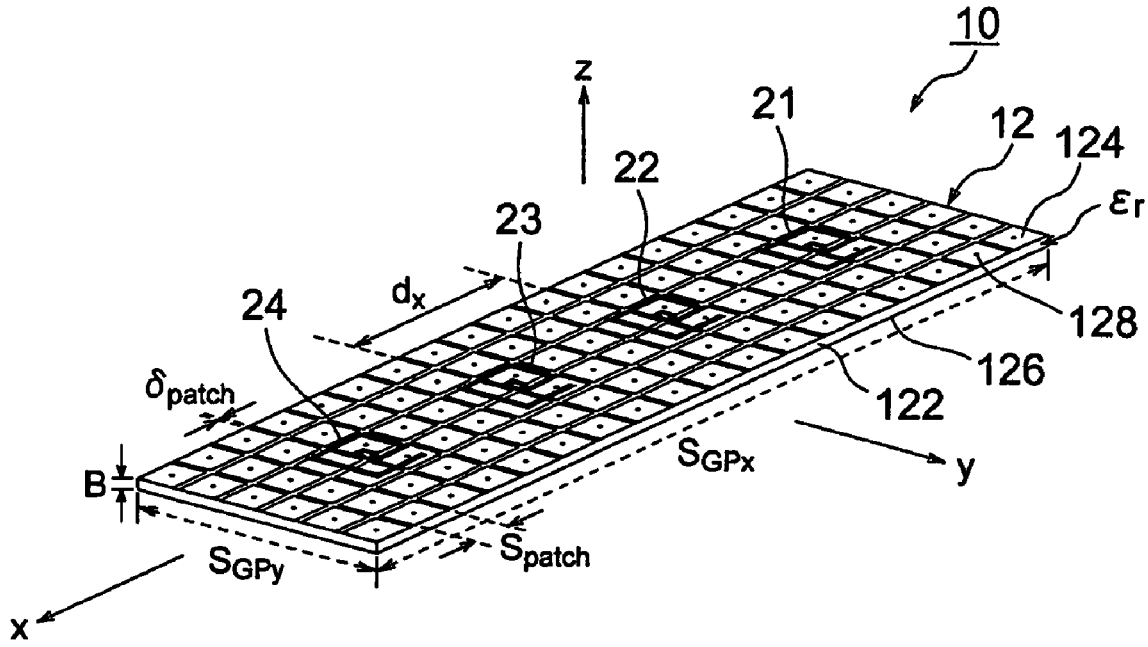
FIG. 1 PRIOR ART
FIG. 1 is a perspective view showing a conventional antenna unit (a monofilar spiral array antenna)

Referring to FIG. 1, a conventional antenna unit 10 will be described at first in order to facilitate an understanding of the present invention. The illustrated conventional antenna unit 10 comprises a monofilar spiral array antenna disclosed in the above-mentioned article. Herein, as shown in FIG. 1, an orthogonal axial system (x, y, x) is used. In the orthogonal axial system (x, y, x), the origin point is a center of a substrate 122 which will later be described, the x-axis extends back and forth (in a depth direction), the y-axis extends to the left or the right (in a width direction), and the z-axis extends up and down (in a vertical direction).

The monofilar spiral array antenna 10 comprises a mushroom-like EBG reflector 12 and first through fourth array elements 21, 22, 23, and 24.

The EBG reflector 12 comprises a rectangular substrate depicted at 122, (Nx×Ny) square patches 124 printed on a principal surface of the substrate 122, a ground plate 126 disposed on a rear surface of the substrate 122. Each square patch 124 has a side length of $S_{patch}$ and is shorted to the ground plate 126 with a conducting pin 128. The substrate 122 on which the patches 124 are printed has a relative permittivity of $\epsilon_r$ and a thickness of B. The ground plate 126 has a length of $S_{GPx}$ in the x-direction and a width of $S_{GPy}$ in the y-direction.

The first through the fourth array elements 21 to 24 are backed or supported by the EBG reflector 12. The first through the fourth array elements 21 to 24 are spaced with an array distance $d_x$ in the x-direction.

Figure 2:
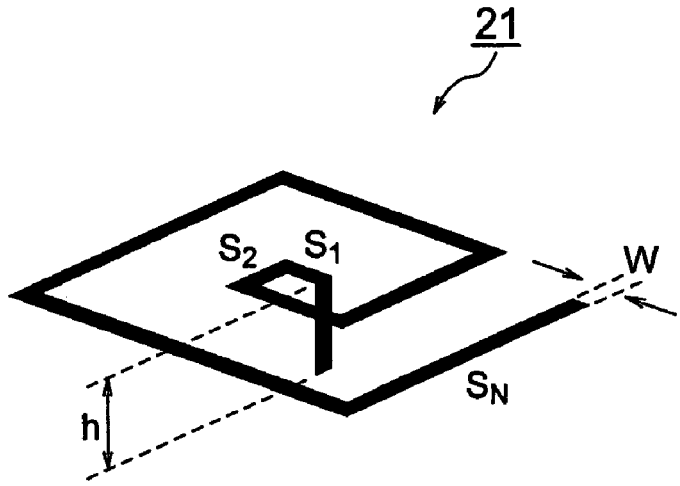
FIG. 2 PRIOR ART
FIG. 2 is a perspective view showing a curl antenna for use in the antenna unit illustrated in FIG. 1.

Referring to FIG. 2, the description will proceed to the first through the fourth array elements 21 to 24. Inasmuch as the first through the fourth array elements 21 to 24 have the same shape (similar structure), the description will be made as regards to the first array element 21 alone. The array element is called a curl antenna.

The array element (the curl antenna) 21 is composed of one vertical filament and N horizontal filaments. The vertical filament has a length, called the antenna height, which is h. The first horizontal filament has a length of $s_1$, the n-th (n=2, 3, . . . , N−1) horizontal filament has a length of $S_n$ which is defined as $s_n=2(n-1)s_1$, and final horizontal filament (the N-th horizontal filament) has a length of $S_N$. All the filaments have a width of w. The spiral (the curl antenna) 21 is fed from the end point of the vertical filament by a coaxial line (not shown).

The illustrated monofilar spiral array antenna 10 has the following parameters. It will be assumed that $\lambda_6$ is the free-space wavelength at a test frequency of 6 GHz. The array distance $d_x$ is equal to $0.88\lambda_6$. The antenna height h is equal to $0.1\lambda_6$. The length $s_1$ of the first horizontal filament is equal to $0.03\lambda_6$. The number N of the horizontal filaments is equal to 8. The width w of the filament is equal to $0.02\lambda_6$. The number (Nx, Ny) of the patches 124 is equal to (18, 6). The side length $S_{patch}$ of the patches 124 is equal to $0.2\lambda_6$. The relative permittivity $\epsilon_r$ of the substrate 122 is equal to 2.2. The thickness B of the substrate 122 is equal to $0.04\lambda_6$. The spacing $\delta_{patch}$ of the patches 124 is equal to $0.02\lambda_6$.

Figure 3:
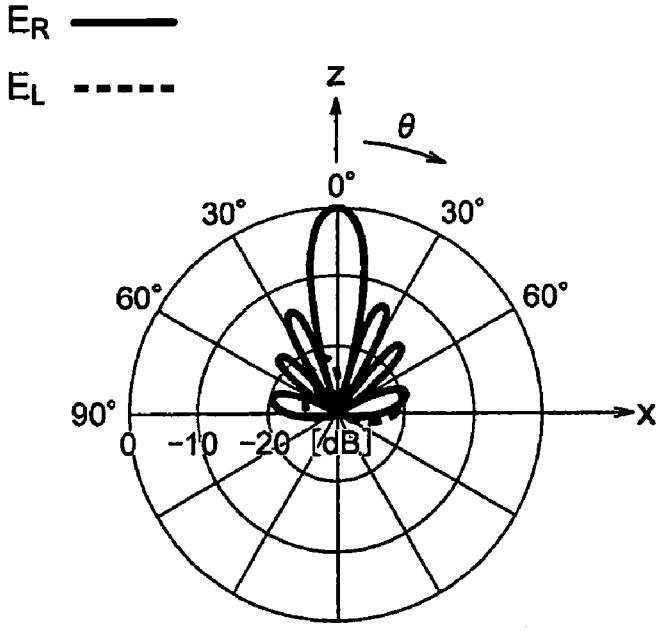
FIG. 3 PRIOR ART
FIG. 3 is a view showing of a radiation pattern of the antenna unit illustrated in FIG. 1.

FIG. 3 shows the radiation pattern of the monofilar spiral array antenna 10 illustrated in FIG. 1 at the frequency of 6 GHz. The illustrated radiation pattern is analyzed by using the finite-difference time-domain method (FDTDM). The radiation field is illustrated with two radiation field components $E_R$ and $E_L$. As seen from the winding sense of the spiral in FIG. 1, the co-polarization radiation field component is $E_R$ and the cross-polarization radiation field component is $E_L$. FIG. 3 clearly shows that array effects narrow circularly polarized (CP) radiation beam; the half-power beam width (HPBW) of the array is calculated to be approximately 14 degrees. It is noted that the HPBW of an array element is 68 degrees.

However, it is necessary for the conventional antenna unit (the monofilar spiral array antenna) 10 illustrated in FIG. 1 to arrange, as an antenna device, a plurality of curl antennas in an array fashion such as the first through the fourth array elements (curl antennas) 21 to 24. Therefore, the monofilar spiral array antenna 10 is disadvantageous in that a feeding method is complicated, as mentioned in the preamble of the instant specification.

Figure 4:
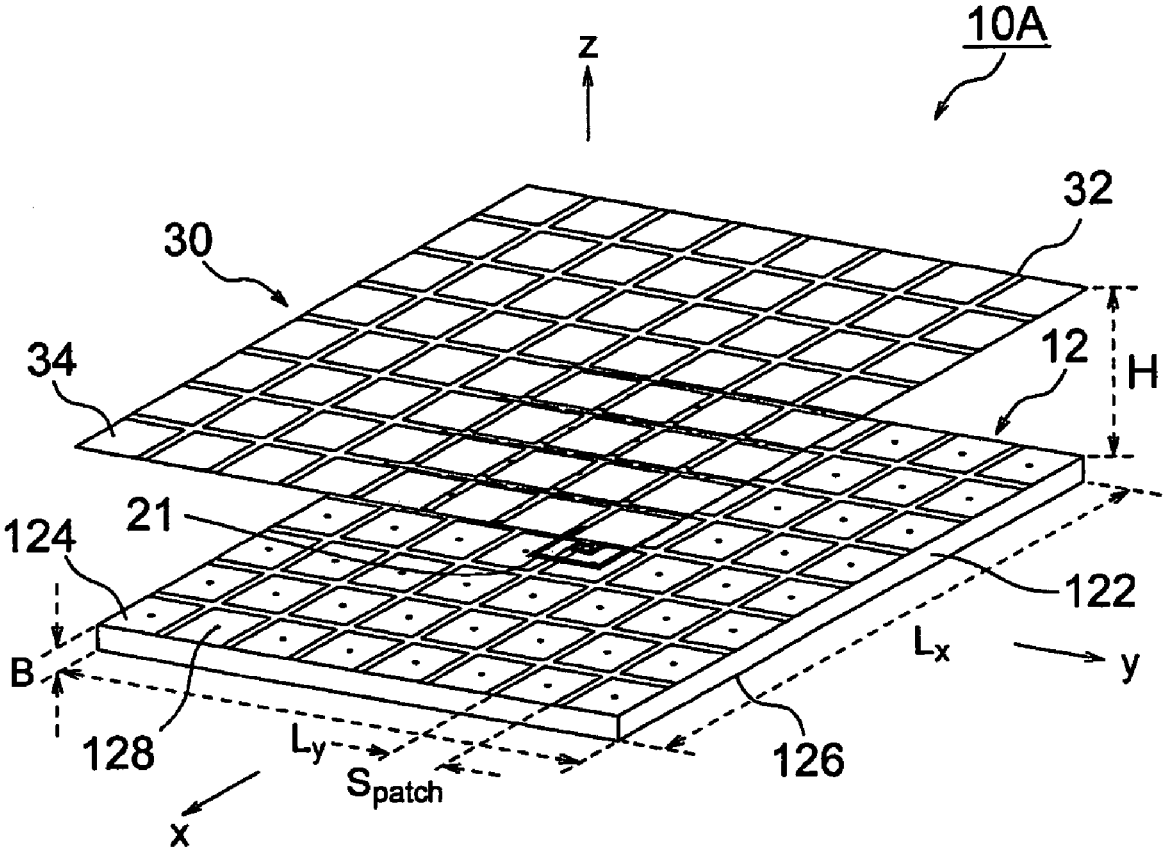
FIG. 4 is a perspective view showing an antenna unit according to an embodiment of this invention.
Figure 5:
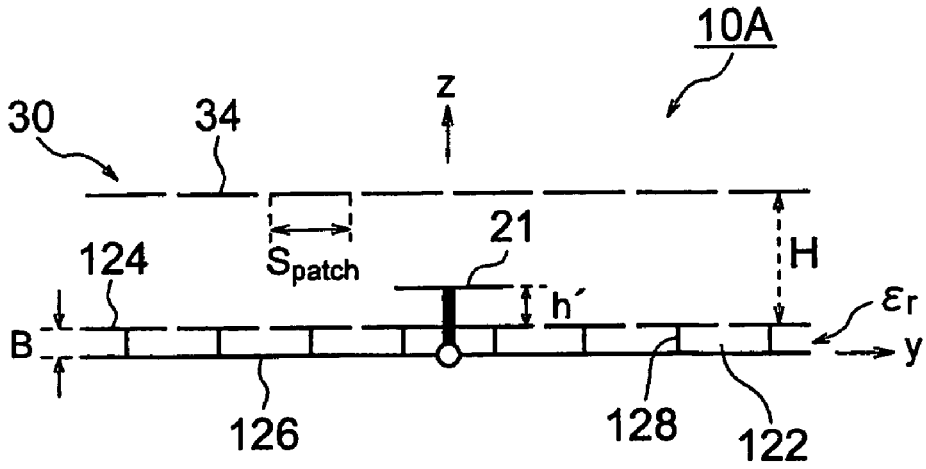
FIG. 5 is a front view of the antenna unit illustrated in FIG. 4.

Referring to FIGS. 4 and 5, the description will proceed to an antenna unit 10A according to an embodiment of this invention. FIG. 4 is a perspective view of the antenna unit 10A. FIG. 5 is a front view of the antenna unit 10A. Herein, in the manner similar in a case of FIG. 1, an orthogonal axial system (x, y, x) is used. In the orthogonal axial system (x, y, x), the origin point is a center of the substrate 122, the x-axis extends back and forth (in a depth direction), the y-axis extends to the left or the right (in a width direction), and the z-axis extends up and down (in a vertical direction).

The illustrated antenna unit 10A comprises the EBG reflector 12 having a principal surface which extends on a plane in parallel with a x-y plane, a curl antenna 21 supported on the principal surface of the EBG reflector 12 at a central portion thereof, a periodic structure upper plate 30 disposed apart from the principal surface of said EBG reflector 12 by a predetermined distance H.

The EBG reflector 12 has structure similar to that described in conjunction with FIG. 1. Specifically, the EBG reflector 12 comprises the substrate 122 having the principal surface, (Nx×Ny) square patches 124 printed on the principle surface of the substrate 122, the ground plate 126 disposed on the rear surface of the substrate 122, and (Nx×Ny) conductive-pins 128 for short-circuiting the (Nx×Ny) square patches 124 to the ground plate 126, respectively. In other words, the (Nx×Ny) square patches 124 are printed on the principle surface of the substrate 122 and are arranged in a matrix fashion (lattice structure). The substrate 122 has the relative permittivity $\epsilon_r$ and the thickness B. The EBG reflector 12 (the substrate 122) has a x-direction length of Lx and a y-direction length of Ly.

Preferably, the substrate 122 may be made of a resin such as Teflon® having a little loss in a high-frequency region.

On the other hand, the curl antenna 21 stands on the central portion of the EBG reflector 12 upwards. The horizontal filaments of the curl antenna 21 lie in a height h' from the principal surface of the substrate 122.

The periodic structure upper plate 30 comprises a film 32 which extends on a plane in parallel with a x-y plane, and (Nx×Ny) square patch-like conductors 34 printed on the film 32. The (Nx×Ny) square patch-like conductors 34 are disposed so as to oppose to the (Nx×Ny) square patches 124, respectively.

Each square patch 124 and each square patch-like conductor 32 have the side length of $S_{patch}$.

A combination of the curl antenna 21 and the periodic structure upper plate 30 serves as an antenna device disposed on the principal surface of the EBG reflector 12.

In the example being illustrated, the antenna unit 10A has the following parameters. The relative permittivity $\epsilon_r$ of the substrate 122 is equal to 2.2. The side length $S_{patch}$ of the each patch 124 and the each patch-like conductor 32 is equal to 10 mm. The thickness B of the substrate 122 is equal to 2.0 mm. The EBG reflector 12 has the x-direction length Lx of 87 mm and the y-direction length Ly of 87 mm. The height h' of the curl antenna 21 is equal to 3.0 mm. The distance H between the EBG reflector 12 and the periodic structure upper plate 30 is equal to 10 mm. The number (Nx, Ny) of the patches 124 and of the square patch-like conductors 34 is equal to (8, 8).

Figure 6:
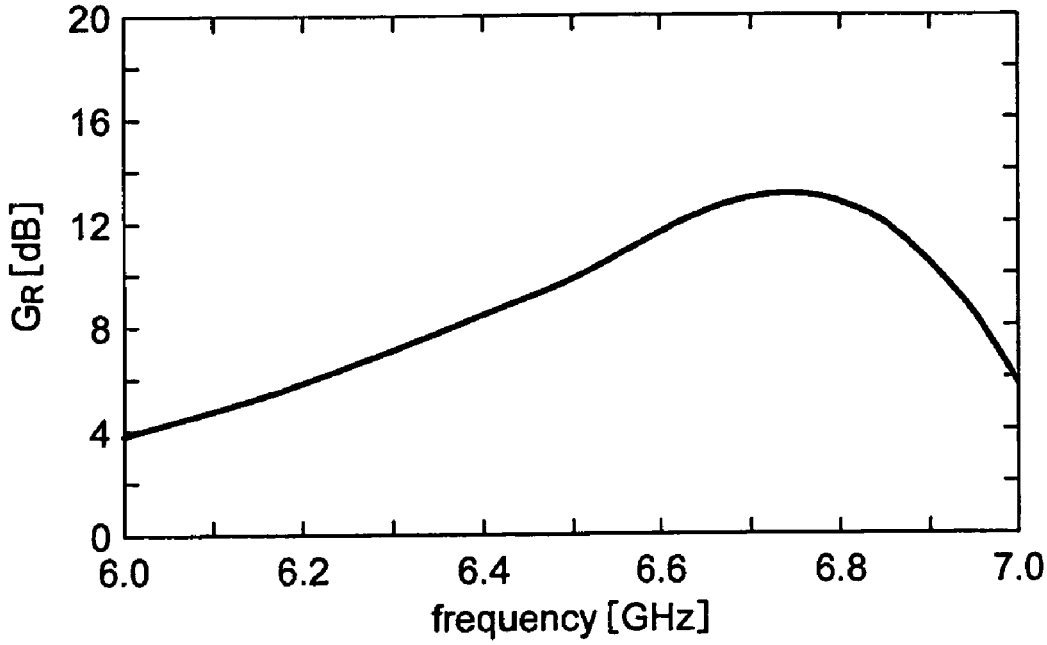
FIG. 6 is a view showing a frequency characteristic of a right revolution circularly polarized gain of the antenna unit illustrated in FIG. 4.

FIG. 6 shows a frequency characteristic of a right revolution circularly polarized gain $G_R$ of the antenna unit 10A. The illustrated frequency characteristic of the right revolution circularly polarized gain $G_R$ is analyzed by using the finite-difference time-domain method (FDTDM). In FIG. 6, the abscissa represents a frequency [GHz] and the ordinate represents the right revolution circularly polarized gain $G_R$ [dB]. As seen in FIG. 6, it is understood that the maximum gain of 13.1 dB is obtained at the frequency of 6.75 GHz. In this event, the height H becomes $0.225\lambda_{6.75}$ where $\lambda_{6.75}$ is the free-space wavelength at the frequency of 6.75 GHz. This maximum gain is larger than by about 4.5 dB in comparison with a case where the periodic structure upper plate 30 is not disposed.

Figure 7:
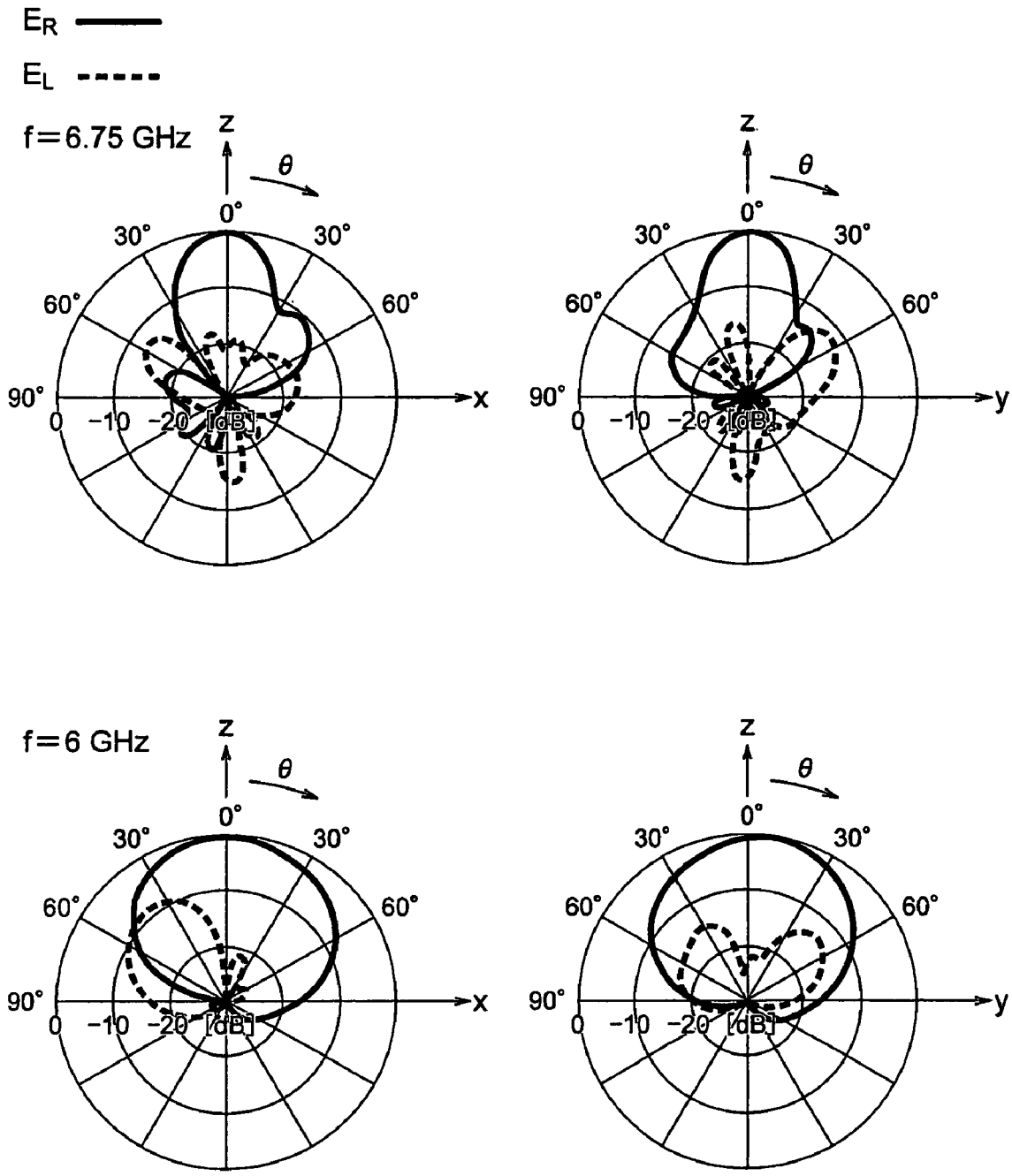
FIG. 7 is a view showing radiation patterns of the antenna unit with a periodic structure upper plate illustrated in FIG. 4 and of an antenna unit without the periodic structure upper plate.

FIG. 7 shows examples of radiation patterns of the antenna unit 10A illustrated in FIGS. 4 and 5. For comparison purposes, FIG. 7 shows radiation patterns in a case where the periodic structure upper plate 30 is not used. In FIG. 7, $E_R$ depicted at a solid line shows the co-polarization radiation field component and $E_L$ depicted at a broken line shows the cross-polarization radiation field component. In addition, in FIG. 7, two radiation patterns of upper side show radiation patterns of the antenna unit 10A with the periodic structure upper plate 30 at the frequency f of 6.75 GHz while two radiation patterns of lower sides show radiation patterns of an antenna unit without the periodic structure upper plate 30 (i.e. consisting of the EBG reflector 12 and the curl antenna 21) at the frequency f of 6 GHz.

As seen in FIG. 7, it is understood that the antenna unit 10A with the periodic structure upper plate 30 has a sharper beam than that of the antenna unit without the periodic structure upper plate 30.

It is therefore possible to encourage gain enhancement of the curl antenna 21 by using the EBG reflector 12 and the periodic structure upper plate 30. In the above-mentioned embodiment, the gain enhancement of about 4.5 dB is obtained.

While this invention has thus far been described in conjunction with a preferred embodiment thereof, it will now be readily possible for those skilled in the art to put this invention into various other manners. For example, although the example where the curl antenna is used as an antenna element is described in the above-mentioned embodiment, a shape of the antenna element may be not restricted to the curl antenna. In addition, although the film on which the patch-like conductors are printed is used as the periodic structure upper plate 30 in the above-mentioned embodiment, a substrate may be used in lieu of the film.

What is claimed is:

1. An antenna unit comprising:

an EBG (Electromagnetic Band Gap) reflector comprising a substrate having a principal surface and (Nx×Ny) square patches which are printed on the principle surface of the substrate and which are arranged in a matrix fashion;

a single antenna element supported by said EBG reflector; and a periodic structure upper plate disposed apart from the principal surface of said EBG reflector by a predetermined distance, wherein said periodic structure upper plate comprises:

a film; and (Nx×Ny) square patch-like conductors printed on said film, said (Nx×Ny) square patch-like conductors being disposed so as to oppose said (Nx×Ny) square patches, respectively.

2. The antenna unit as claimed in claim 1, wherein said single antenna element is substantially disposed in a center of said EBG reflector.

3. The antenna unit as claimed in claim 1, wherein said single antenna element comprises a curl antenna.

4. The antenna unit as claimed in claim 1, wherein said EBG reflector further comprises:

a ground plate disposed on a rear surface of said substrate; and (Nx×Ny) conductive-pins for short-circuiting said (Nx×Ny) square patches to said ground plate, respectively.

* * * * *